US005806226A

United States Patent [19]

Norton et al.

[11] Patent Number: 5,806,226

[45] Date of Patent: Sep. 15, 1998

[54] BOLT ASSEMBLY FOR ELECTRONIC FIREARM

[75] Inventors: Vincent B. Norton, Elizabethtown; James W. Ronkainen, Hodgenville, both of Ky.

[73] Assignee: Remington Arms Company, Inc., Madison, N.C.

[21] Appl. No.: 713,676

[22] Filed: Sep. 17, 1996

Related U.S. Application Data

[63] Continuation-in-part of Ser. No. 680,490, Jul. 15, 1996.

[51] Int. Cl.[6] ..... F41A 19/70

[52] U.S. Cl. ..... 42/84; 89/28.05

[58] Field of Search ..... 42/84; 89/28.05, 89/28.1

[56] References Cited

U.S. PATENT DOCUMENTS

| | | | |
|---|---|---|---|
| 337,872 | 3/1886 | Russell | 42/84 |
| 2,957,391 | 10/1960 | Lovercheck | 89/28.05 |
| 3,255,547 | 6/1966 | Gregory, Jr. . | |
| 3,299,812 | 1/1967 | Suh et al. | 102/39 |
| 3,613,282 | 10/1971 | Ramsay . | |
| 3,650,174 | 3/1972 | Nelsen . | |
| 4,329,908 | 5/1982 | Rowlands | 89/24 |
| 5,405,394 | 4/1995 | Davidson | 623/18 |
| 5,608,982 | 3/1997 | Bouvard et al. | 42/84 |
| 5,640,026 | 6/1997 | Terazono | 257/192 |

FOREIGN PATENT DOCUMENTS

| | | | |
|---|---|---|---|
| 2072811 | 10/1981 | United Kingdom | 42/84 |

*Primary Examiner*—Charles T. Jordan
*Assistant Examiner*—Christopher K. Montgomery
*Attorney, Agent, or Firm*—Huntley & Associates

[57] ABSTRACT

Bolt assembly for use in a firearm for firing electrically activated ammunition.

18 Claims, 5 Drawing Sheets

BOLT ASSEMBLY FOR ELECTRONIC FIREARM

CROSS-REFERENCE TO RELATED APPLICATION

This is a Continuation-in-part of copending application Ser. No. 08/680,490, filed Jul. 15, 1996.

BACKGROUND OF THE INVENTION

This invention relates to firearms and more particularly to electronic firearms. Specifically, the present invention relates to a bolt assembly adapted to fire electrically activated ammunition from an electronic firearm. While there are many prior references to electronic firearms in general, and more specifically to electronic firearms for firing electrically activated ammunition, these prior references have failed to provide a bolt assembly that moved and felt like the bolt assembly of a mechanical firearm.

SUMMARY OF THE INVENTION

The present invention provides a bolt assembly for use in an electronic firearm, the bolt assembly appearing to operate and function in much the same manner as a bolt assembly of a mechanical firearm despite being adapted to fire electrically activated ammunition.

Specifically, the present invention provides a bolt assembly for use in an electronic firearm, the firearm comprising a barrel having a chamber, a receiver, a stock, a safety, and a trigger assembly; the bolt assembly comprising a bolt body, and a moveable electrically conductive firing pin assembly within the bolt body, the firing pin assembly being adjustable with respect to the bolt assembly, the bolt assembly having front and rear ends and being positioned within the receiver, behind and substantially aligned with the barrel, the bolt assembly adapted to convey a round of ammunition from the receiver to the chamber, to fire electrically activated ammunition, and to be moved rotationally and longitudinally within the receiver among at least the open, closed, and closed and locked positions.

DETAILED DESCRIPTION OF THE INVENTION

Figure 2:
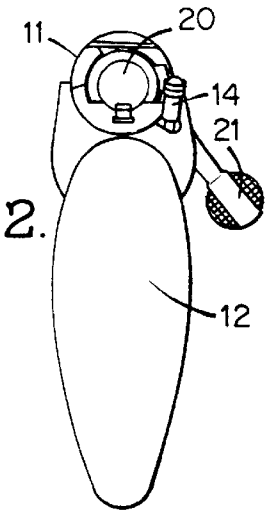
FIG. 2 is a rear elevational view of the firearm of FIG. 1.
Figure 1:
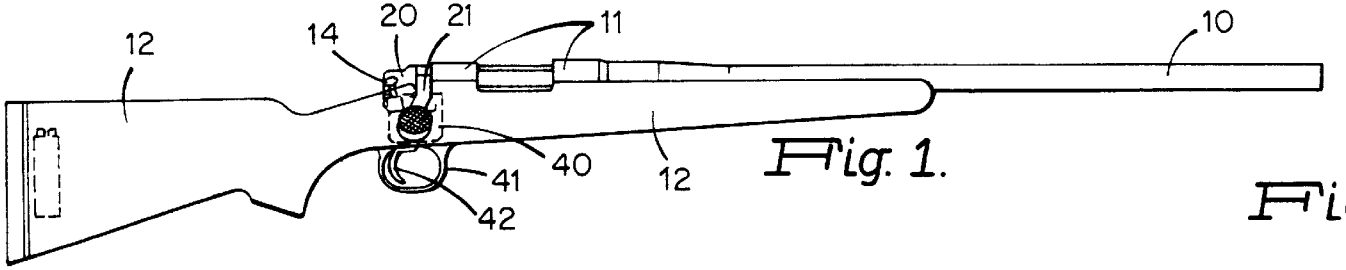
FIG. 1 is a side elevational view of a firearm having a bolt assembly of the present invention.

The present invention will be more fully understood by reference to the figures. FIGS. 1 and 2 show a firearm having a bolt assembly of the present invention. FIGS. 3 through 10 show various aspects of one possible embodiment of a bolt assembly of the present invention. Variations and modifications of this embodiment can be substituted without departing from the principles of the invention, as will be evident to those skilled in the art.

In FIGS. 1 and 2 the firearm has a barrel 10 which is attached to receiver 11, and a stock 12. Both the barrel and receiver are encased in the stock 12. The barrel has a chamber formed in its rear end where it is attached to the receiver. The chamber is connected and adapted to receive ammunition from the receiver. A bolt assembly, generally indicated as 20, is movably positioned within the receiver, behind and substantially aligned with the barrel, and has a handle 21. The barrel 10, receiver 11, bolt assembly 20, and trigger assembly 40 comprise the barrel assembly of the firearm. A safety switch 14, is shown behind the bolt assembly. The bolt assembly is shown in FIGS. 1 and 2 in a closed and locked position.

Figure 3:
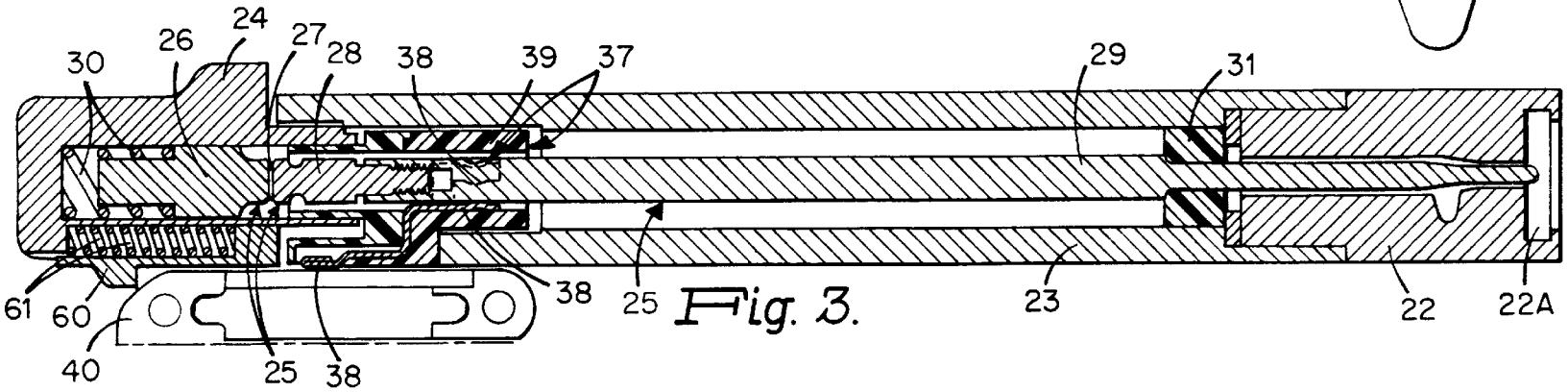
FIG. 3 is a cross sectional view in elevation of one embodiment of a bolt assembly of the present invention.
Figure 8:
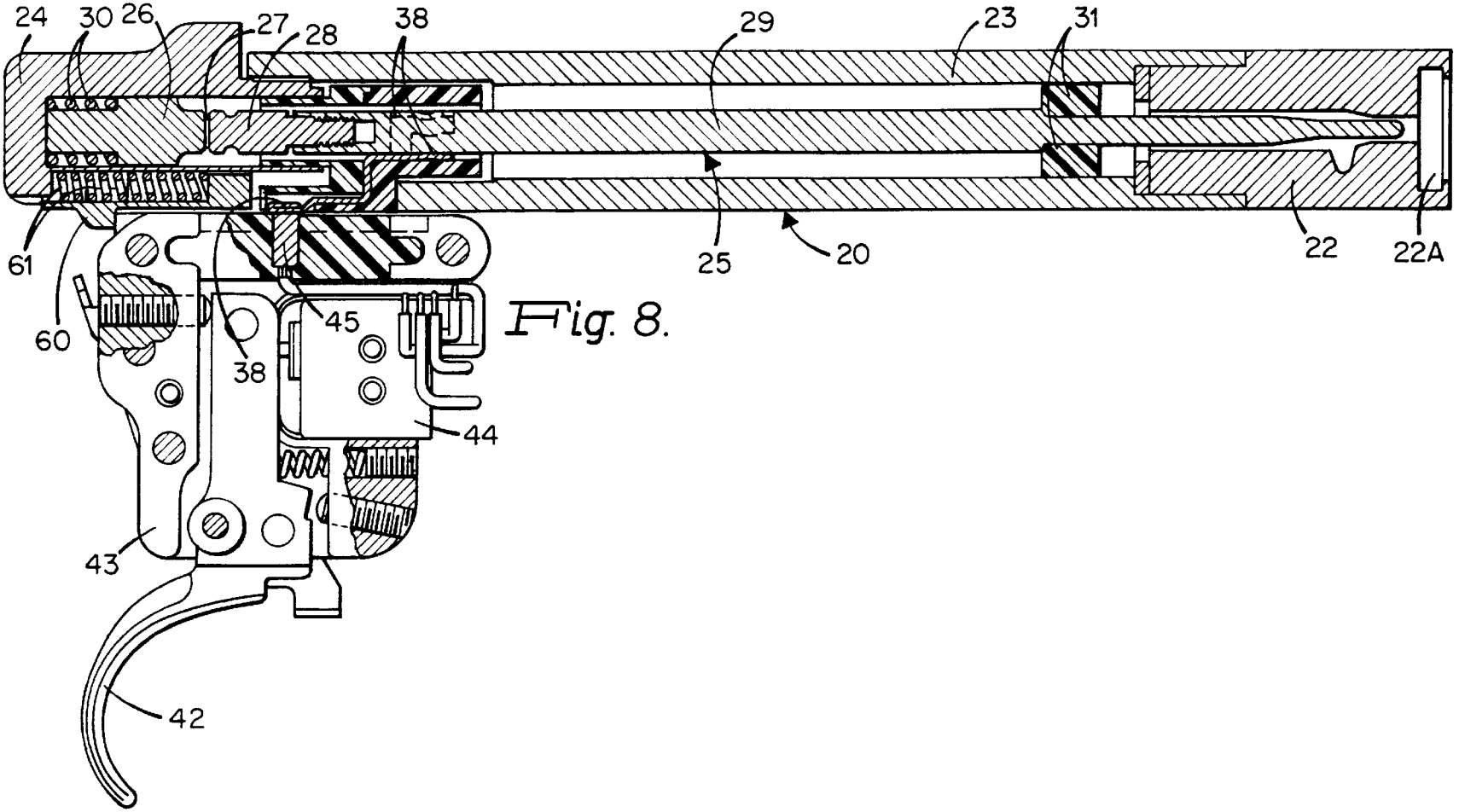
FIG. 8 is a cross sectional view in elevation of the bolt assembly shown in FIG. 3, with the firing pin assembly biased rearward.
Figure 9:
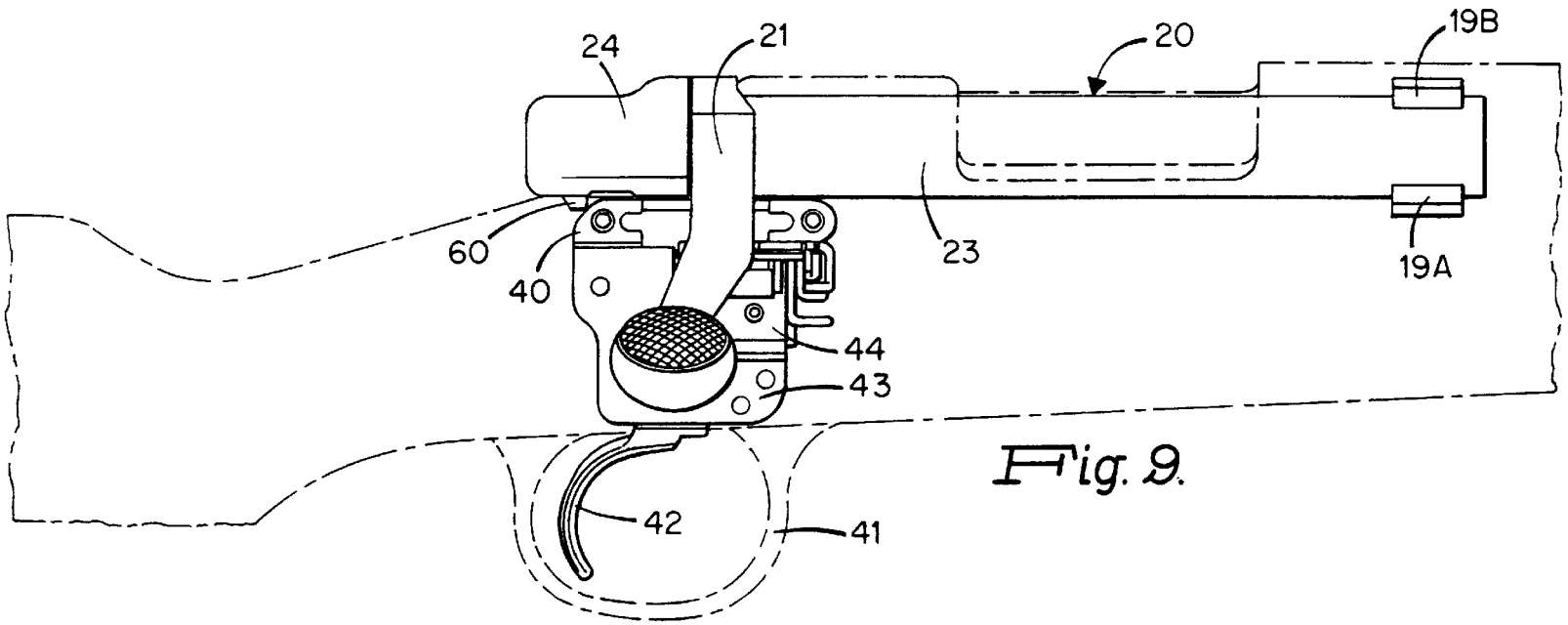
FIG. 9 is a side elevational view of the firearm of FIG. 1, with a portion of the firearm shown in phantom outline for clarity, showing the bolt assembly of the present invention in the closed and locked position.
Figure 10:
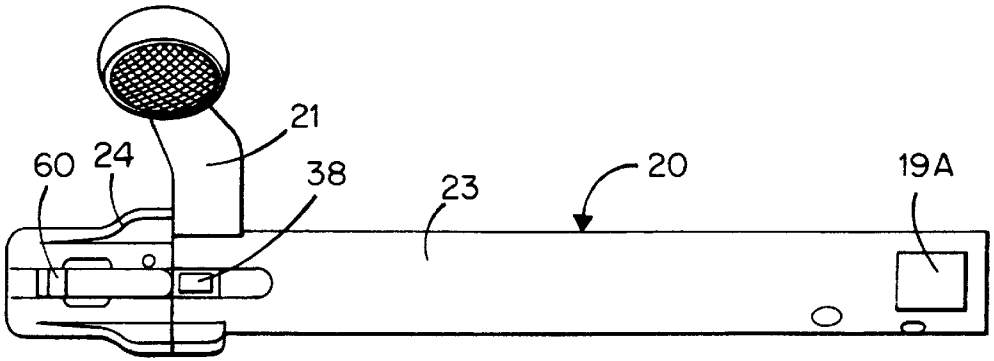
FIG. 10 is a bottom plan view of the bolt assembly shown in FIG. 9.

In the Figures, particularly FIGS. 3 and 8, the bolt assembly 20 has front and rear ends and a bolt head 22 comprising a bolt face 22A at the front end. The bolt assembly can move longitudinally and rotationally within the receiver. More specifically, the bolt assembly can be moved among at least the opened, closed, and closed and locked positions. When the bolt assembly is closed the bolt face is positioned within the rear of the chamber of the barrel. At the rear end of the bolt assembly a handle 21 is provided for moving the bolt to its alternate open, closed, and closed and locked positions. Trigger assembly 40 is located below the receiver in the stock, and includes trigger guard 41 which extends below and beyond the stock, and trigger 42.

The bolt assembly is positioned within the receiver behind and substantially aligned with the barrel. The bolt assembly includes a hollow bolt body 23 operatively connected at its rear end to a hollow bolt plug 24 which is sealed at its rear end, and handle 21 on the rear of the bolt assembly which acts as a lever for moving the bolt assembly within the receiver. A movable firing pin assembly 25 is positioned within the bolt assembly and consists of a firing pin plunger 26, a firing pin plunger insulator 27, a firing pin plug 28, and the firing pin itself 29. The firing pin plunger is operatively connected at its forward end to the firing pin plug, and the firing pin plug is operatively connected at its forward end to the firing pin within the bolt body. The firing pin plunger insulator is positioned between the firing pin plunger and the firing pin plug. The firing pin plunger insulator can be a separate component attached to the forward end of the firing pin plunger, or it can comprise an insulating treatment to the forward end of the firing pin plunger or a treatment to the firing pin plug.

A firing pin spring 30, positioned between the sealed rear end of the bolt plug and the firing pin plunger, biases the firing pin forward by acting on the firing pin plunger. A firing pin shoulder 31 within the front end of the bolt body is positioned to restrict the forward movement of the firing pin, and the rearward movement of the firing pin is limited by the plunger contacting the rear of the bolt plug. FIG. 3 shows the firing pin assembly biased forward to contact a round of ammunition within the chamber of the barrel, while FIG. 8 shows the firing pin assembly biased rearward.

The firing pin plunger, firing pin plunger insulator, firing pin plug, and the firing pin are operatively connected to form the firing pin assembly. In alternate embodiments, the firing pin shoulder can be connected to the firing pin and a part of the firing pin assembly, or it can be positioned within the bolt body. The firing pin assembly is moveable within the bolt assembly, but its range of motion is restricted. Specifically, the firing pin shoulder within the front end of the bolt body is positioned to restrict the forward movement of the firing pin assembly by limiting the forward movement of the firing pin, and the rearward movement of the firing pin assembly is limited by the rear of the firing pin plunger contacting the rear of the bolt plug.

The movable firing pin assembly, shown in FIG. 3 biased forward by firing pin spring 30, ensures contact between the forward conductive tip of the firing pin and the primer at the rear of a round of ammunition within the chamber when the bolt assembly is closed and locked by permitting the firing pin assembly to position itself to compensate for manufacturing variations in ammunition. Rearward travel of the firing pin is limited, as shown in FIG. 8, to provide support for ammunition within the chamber.

In addition, the firing pin plug and the firing pin are adapted to be adjustably connected, permitting individual adjustment of the firing pin in relation to the firing pin plug so that the forward tip of the firing pin is adjustable with respect to the bolt face when the firing pin is biased into its rearwardmost position, as shown in FIG. 8. When in the rearward position, the firing pin assembly thus supports the ammunition during firing and cannot become lodged within the bolt body when it is forced rearward by the ignition of a round of ammunition within the chamber.

In an alternate embodiment of the firing pin assembly not here shown, the firing pin plug can be a threaded adjustment screw, and the bolt plug has a threaded aperture formed in its rear end adapted to receive the adjustment screw. The firing pin spring in the bolt plug biases the firing pin assembly forward by acting on the bolt plug and the firing pin plunger. The adjustment screw contacts the rear of the firing pin plunger to restrict the rearward motion of the firing pin assembly, and can be set so that the forward tip of the firing pin is adjustable with respect to the bolt face when the firing pin is in its rearwardmost position. As in the embodiment of the firing pin assembly shown in the figures, the firing pin is biased forward to compensate for dimensional variations in ammunition to assure that the firing pin will be positioned to contact a round of ammunition within the chamber.

The bolt assembly is movably mounted within the receiver of the firearm, and its movement is also limited. On the forward end of the bolt assembly, the bolt head 22 is operatively connected to the front end of the bolt body and has lugs 19A and 19B positioned to engage slots (not shown) formed in the front of the receiver. The slots extend from the rear to the front of the receiver. The engagement between the lugs and the slots guides the bolt assembly, and defines its positions as opened, closed or closed and locked. In addition, when the bolt assembly is closed and locked, the engagement between the lugs and the slots prevents rearward motion of the locked bolt assembly.

Figures 5, 6, 7:
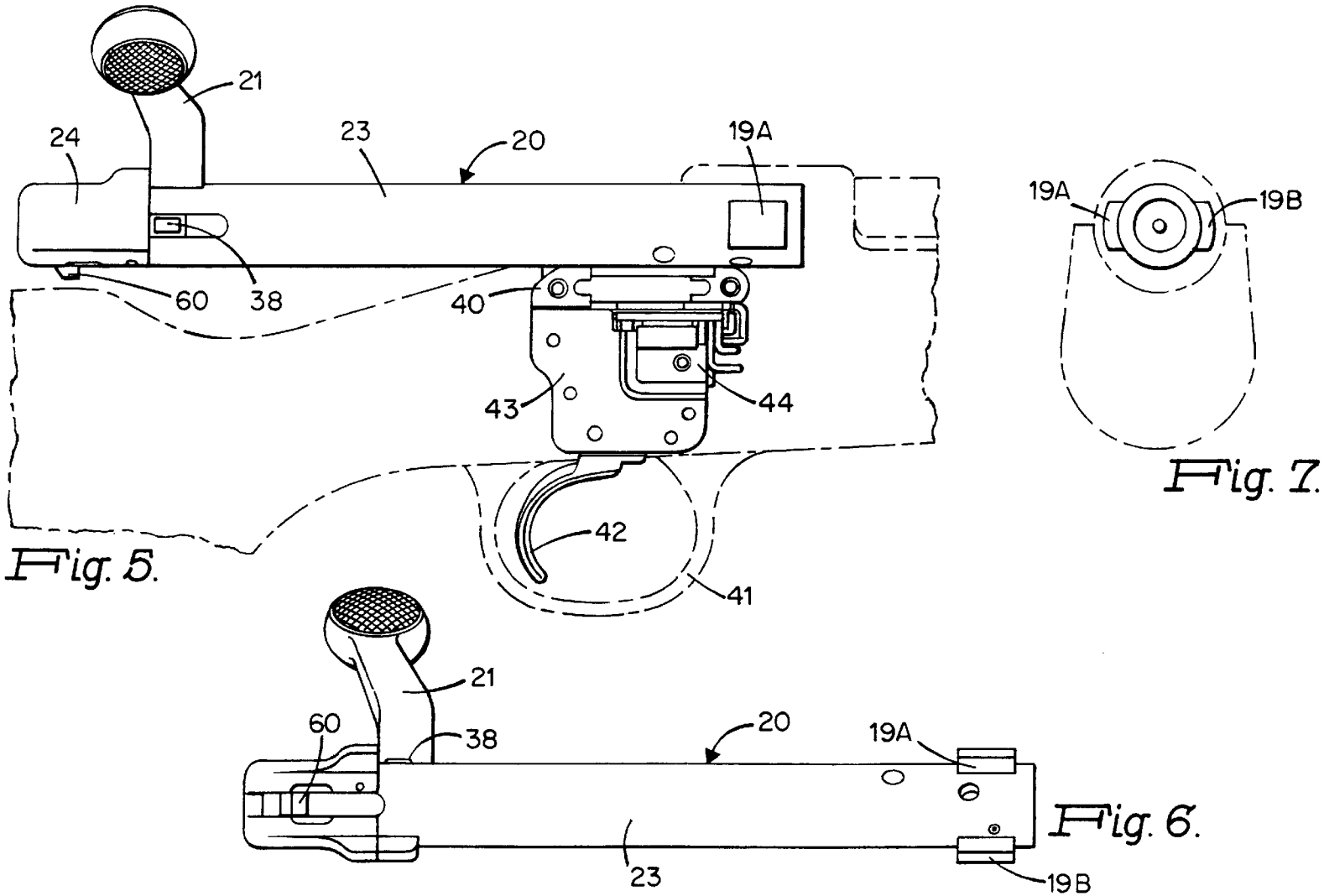
FIG. 5 is a side elevational view of the firearm of FIG. 1, with a portion of the firearm shown in phantom outline for clarity, showing the bolt assembly of the present invention in the open position.
FIG. 6 is a bottom plan view of the bolt assembly shown in FIG. 5.
FIG. 7 is a front elevational view of FIG. 5, with the firearm and barrel drawn in phantom.

The forward motion of the bolt assembly is also restricted when it is in the closed and locked position by a bolt plug detent 60 on the bottom of the bolt plug. The bolt plug detent also prevents rotation of the bolt plug when the bolt assembly is in the open position by engaging a notch in the rear of the bolt body, as shown in FIG. 6. The bolt plug detent is biased forward by a bolt plug detent spring 61. The bolt plug detent further restricts the forward movement of the bolt assembly by contacting the trigger housing when the bolt assembly is closed, and restricts forward motion when the bolt is locked. The bolt plug detent and detent spring serve a similar function as a firing pin head and sear in a mechanical firearm, providing resistance and tension to the bolt assembly when it is closed and locked, and preventing the bolt assembly from inadvertently moving from the closed and locked position. The contact between the bolt plug detent and the trigger housing secures the bolt assembly by restricting forward motion of the bolt assembly when it is in the locked position, and the engagement between the lugs and the slots further secures the bolt assembly by preventing rearward motion of the bolt assembly when it is locked.

In the embodiment of the bolt assembly shown, particularly in FIGS. 3 and 8, a firing pin contact assembly 37 consists of an electrical contact 38 and an insulating housing 39 fixed within the rear of the bolt assembly to rotate and move with the bolt assembly. The firing pin contact is positioned to connect the conductive area at the rear of the firing pin, or, in the alternate embodiment discussed above but not shown, to connect the conductive area at the rear of the firing pin assembly, with an electrical contact on the trigger assembly. The circuit between the firing pin contact and the electrical contact on the trigger assembly can only be completed when the bolt assembly is in the closed and locked position. The firing pin contact and the conductive area at the rear of the firing pin remain connected when the bolt is locked, even as the firing pin is biased forward by the firing pin spring and rearward by a round of ammunition within the chamber of the barrel, thus allowing for dimensional variations in individual rounds of ammunition and ensuring electrical contact between the firing pin and the firing pin contact despite those variations. In addition, the movably mounted bolt assembly ensures that an electrical connection cannot be made between the firing pin and the trigger assembly electrical contact unless the bolt is in the closed and locked position. In an alternate embodiment of the invention, the contact point can be the firing pin plug, which then transmits the current to the ammunition in the chamber.

Figure 4:
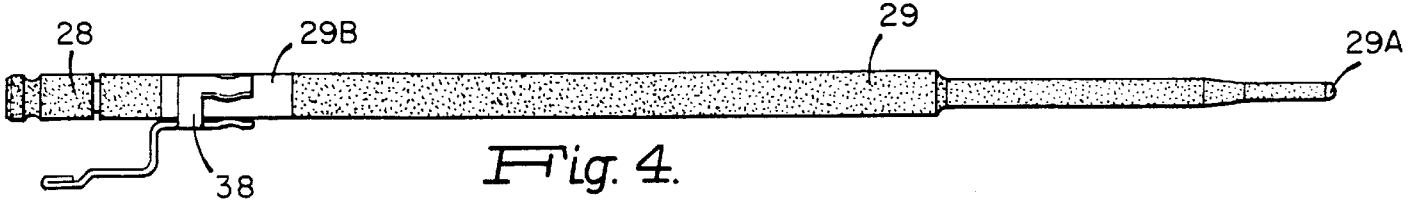
FIG. 4 is a side elevational view of one embodiment of a firing pin assembly that can be used in an embodiment of the bolt assembly of the present invention.

In FIG. 4, the embodiment of the firing pin shown is provided with electrical isolation means to insulate the body of the firing pin. The electrical isolation means is shown as stippling in the figure. The electrical isolation means does not insulate the firing pin at a forward conductive end 29A and rearward conductive area 29B. The forward conductive end is positioned to transmit voltage to a round of ammunition within the chamber of the barrel only when the bolt assembly is in a closed and locked position, and the rearward conductive area is positioned to receive voltage only when the bolt assembly is in the closed and locked position. Within these parameters, the electrical isolation means can vary widely, and can comprise an electrically insulating sleeve around appropriate portions of the firing pin, a surface coating on the firing pin, or a surface modification of the firing pin. Coating materials which can be used for the firing pin include, for example, polymers applied preformed or in situ. Amorphous diamond or ceramics can also be used for an insulating coating on the firing pin. Of the many known ceramics that can be used, those found to be particularly satisfactory include alumina and magnesia stabilized zirconia. Surface modification of the firing pin can also include, for example, ion implantation. Still other coatings or treatments for the firing pin will be evident to those skilled in the art.

The preferred trigger assembly shown in the figures comprises a trigger housing 43 which houses a trigger 42 operatively connected to a switch 44, and a trigger assembly contact 45. The trigger assembly contact is positioned to contact the firing pin contact at the rear end of the bolt assembly, only when the bolt assembly is in the closed and locked position. When the bolt assembly is in the closed and locked position, the trigger assembly contact and the firing pin contact are aligned to form a closed circuit. In firearms having a system control means to control and monitor electronic functions, the system control can be programmed to only permit power to be transmitted through the trigger assembly contact, the firing pin contact, and the firing pin, to a round of ammunition within the chamber.

Figure 11:
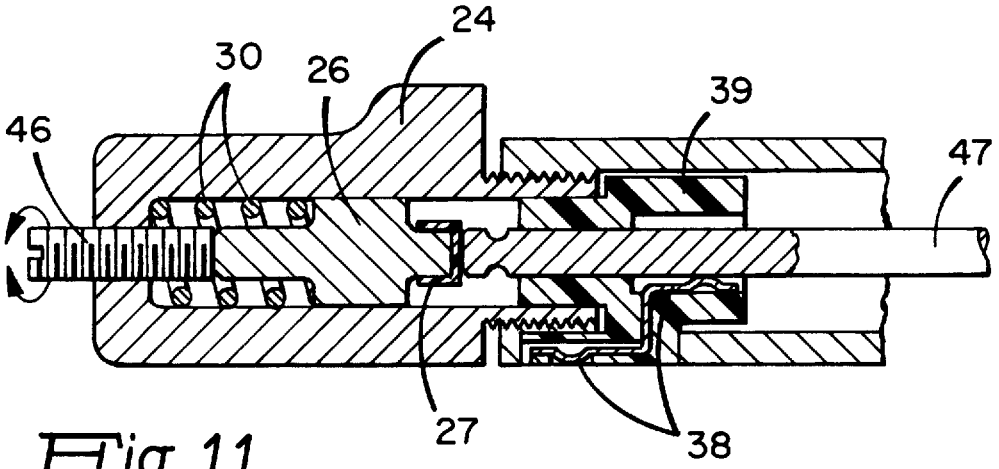
FIG. 11 is a cross-sectional view in elevation of a preferred adjustment means for the bolt assembly of the present invention.

An alternative and preferred adjustment means is shown in FIG. 11. There, the firing pin plug has a threaded firing pin adjustment screw 46 adapted to fit into a threaded aperture in the rear end of the bolt plug 24, and the firing pin assembly comprises the adjustment screw at its rearward end, the screw Operatively connected to a firing pin plunger 26 and a unitary firing pin 47. A firing pin plunger insulator 27 is positioned between the firing pin and the firing pin plunger, and the firing pin assembly is biased forward by the firing pin spring 30 acting on the firing pin plunger and the rear of the bolt plug.

The bolt assembly of the present invention provides a desirable combination of advantages. Specifically, when used in a firearm for firing electrically activated ammunition, the present invention provides a more reliable and accurate means of electrically activating ammunition within the chamber of a firearm. The movable configuration of the bolt assembly permits the firing pin to transmit power to ammunition within the chamber only if the bolt assembly is in the closed and locked position. In some embodiments, if the bolt assembly is not in the closed and locked position, it will not be aligned with the contact on the trigger assembly, and thus the firing pin will be electrically isolated. The firing pin is movable within the bolt assembly to ensure contact between the firing pin and a round of ammunition within the chamber, given the reasonable tolerances and minute variations in the ammunition. Rearward movement of the firing pin is restricted so as to lend support to the primer of a round of ammunition within the chamber prior to and during electronic activation of the ammunition.

The bolt assembly of the present invention has transformed some of the functions previously associated with a moveable bolt assembly in a mechanical percussion firearm into analogous and novel functions in an electronic firearm for firing electrically activated ammunition The result is an improved firearm for firing electrically activated ammunition having increased reliability while retaining much of the feel and operational requirements of a mechanical firearm. An operator accustomed to mechanical firearms can be comfortable operating an electronic firearm having a bolt assembly of the present invention because the movement of the bolt assembly corresponds to the movement of a mechanical bolt assembly.

In addition to the above advantages, the present invention provides a means of increasing the inherent accuracy of a firearm by reducing its lock time and eliminating the physical movement typically associated with a mechanical or percussion firing pin.

We claim:

1. A bolt assembly for use in an electronic firearm, the firearm comprising a barrel having a chamber, a receiver, a stock, a safety, and a trigger assembly; the bolt assembly comprising a bolt body, and a moveable electrically conductive firing pin assembly within the bolt body, means for adjusting the firing pin assembly with respect to the bolt assembly, the bolt assembly having front and rear ends and being positioned within the receiver, behind and substantially aligned with the barrel, the bolt assembly adapted to convey a round of ammunition from the receiver to the chamber, to fire electrically activated ammunition, and to be moved rotationally and longitudinally within the receiver among at least the open, closed, and closed and locked positions, and wherein the firing pin is positioned to contact and remain in contact with a round of ammunition within the chamber when the bolt is in the closed and locked position.

2. A bolt assembly of claim 1 further comprising a bolt handle capable of moving the bolt assembly rotationally and longitudinally within the receiver.

3. A bolt assembly of claim 1 wherein the firing pin assembly further comprises a firing pin contact assembly.

4. A bolt assembly of claim 3 wherein the firing pin contact assembly comprises an electrically insulated firing pin contact housing, and an electrically conductive firing pin contact.

5. A bolt assembly of claim 1 further comprising a hollow bolt body operatively connected at its rear end to a bolt plug assembly, a bolt handle on the rear of the bolt assembly, and a firing pin spring to bias the firing pin assembly forward by acting between the bolt plug and the rear of the firing pin assembly.

6. A bolt assembly of claim 5 wherein the bolt plug assembly comprises a hollow bolt plug sealed at its rear end, and the firing pin assembly within the bolt body comprises a firing pin plunger at its rearward end, the firing pin plunger positioned within the bolt plug and operatively connected to a firing pin plug, a firing pin plunger insulator between the firing pin plunger and the firing pin plug, and a firing pin at the forward end of the firing pin assembly, a firing pin spring and a firing pin shoulder within the front end of the bolt body positioned to restrict the forward movement of the firing pin, the rearward movement of the firing pin being limited by the plunger contacting the rear of the bolt plug, a bolt head operatively connected to the front end of the bolt body having lugs positioned to engage slots extending from the front of the receiver into the rear of the chamber of the barrel, a firing pin contact assembly at the rear end of the bolt assembly positioned to connect the rearward conductive area of the firing pin with an electrical supply contact when the bolt assembly is in the closed and locked position.

7. A bolt assembly of claim 5 wherein the bolt plug assembly further comprises a bolt plug detent on the bolt plug, a bolt plug detent spring positioned between the bolt plug and the bolt plug detent to bias the bolt plug detent forward, and a projection on the bolt plug detent positioned to engage the trigger assembly when the bolt is closed.

8. A bolt assembly of claim 6 wherein the firing pin plug and the firing pin are adapted to be adjustably connected to permit adjustment of the firing pin in relation to the firing pin plug so that the forward tip of the firing pin is adjustable with respect to the forward end of the bolt assembly when the firing pin is in its rearwardmost position.

9. A bolt assembly of claim 6 wherein the firing pin plug is a threaded firing pin adjustment screw adapted to fit into a threaded aperture in the rear end of the bolt plug, and the firing pin assembly comprises the firing pin adjustment screw at its rearward end, the screw operatively connected to a firing pin plunger, the firing pin at the forward end of the firing pin assembly operatively connected to the firing pin plunger, and a firing pin plunger insulator between the firing pin and the firing pin plunger, the firing pin assembly being biased forward by the firing pin spring acting on the firing pin plunger and the rear of the bolt plug.

10. A bolt assembly of claim 7 wherein the projection on the bolt plug detent, biased forward by the bolt plug detent spring, is positioned to contact a projection on the rear end of the trigger assembly and wherein the bolt assembly, when in the closed and locked position, is biased rearward by the interaction of the detent and the mating projection, securing the bolt assembly in position with the help of the interaction of the lugs with the slots in the receiver.

11. A bolt assembly of claim 1 further comprising means for electrically isolating portions of the firing pin assembly.

12. A bolt assembly of claim 11 wherein the means for electrically isolating portions of the firing pin comprises a surface modification.

13. A bolt assembly of claim 12 wherein the surface modification comprises ion implantation.

14. A bolt assembly of claim 11 wherein the electrical isolation means comprises an insulating coating.

15. A bolt assembly of claim 14 wherein the insulating coating comprises amorphous diamond.

16. A bolt assembly of claim 14 wherein the insulating coating comprises ceramic.

17. A bolt assembly of claim 16 wherein the ceramic is selected from the groups consisting of alumina and magnesia stabilized zirconia.

18. A bolt assembly of claim 11 wherein the means for electrically isolating portions of the firing pin assembly comprises an insulating sleeve.

* * * * *